US007928344B2

(12) United States Patent
Jeong

(10) Patent No.: US 7,928,344 B2
(45) Date of Patent: Apr. 19, 2011

(54) APPARATUS AND METHOD FOR MONITORING HOT SURFACE OF COOK TOP

(75) Inventor: Shin Jae Jeong, Jinhae-si (KR)

(73) Assignee: LG Electronics Inc., Seoul (KR)

( * ) Notice: Subject to any disclaimer, the term of this patent is extended or adjusted under 35 U.S.C. 154(b) by 453 days.

(21) Appl. No.: 11/657,074

(22) Filed: Jan. 24, 2007

(65) Prior Publication Data

US 2007/0170169 A1 Jul. 26, 2007

(30) Foreign Application Priority Data

Jan. 25, 2006 (KR) ..... 10-2006-0007703

(51) Int. Cl.
*H05B 3/68* (2006.01)

(52) U.S. Cl. ..... 219/448.12; 219/448.17; 219/445.1; 219/443.1

(58) Field of Classification Search ..... 219/448.12, 219/445.1, 506, 448.11, 446.1, 490, 494
See application file for complete search history.

(56) References Cited

U.S. PATENT DOCUMENTS 4,639,578 A * 1/1987 Payne ..... 219/468.2
4,740,664 A * 4/1988 Payne et al. ..... 219/448.12
6,169,486 B1 1/2001 Berkcan et al. ..... 340/584
7,087,866 B2 * 8/2006 de Los Toyos et al. .. 219/448.11
2004/0256378 A1 * 12/2004 Shukla ..... 219/490

FOREIGN PATENT DOCUMENTS

EP 1 028 602 B1 8/2000
EP 1 489 479 B1 12/2004
FR 2 809 164 11/2001
JP 64-045079 2/1989

* cited by examiner

*Primary Examiner* — Quang T Van
*Assistant Examiner* — Jianying Atkisson
(74) *Attorney, Agent, or Firm* — KED & Associates, LLP

(57) ABSTRACT

Provided are an apparatus and a method for monitoring a hot surface of a cook top. The apparatus includes a display unit, a temperature detecting sensor, and a microprocessor. The display unit displays a state of a hot surface and an operation error of a hot plate as a heater operates. The temperature detecting sensor is installed closely to the heater to detect heater temperature greater than set temperature. The microprocessor compares the heater temperature greater than the set temperature that is detected by the temperature detecting sensor with heater temperature greater than the set temperature that is expected by an elapse of an operating time of the heater to judge one of a hot surface and an operation error of the hot plate, and controls the judgment results to be displayed using the display unit.

9 Claims, 4 Drawing Sheets

APPARATUS AND METHOD FOR MONITORING HOT SURFACE OF COOK TOP

BACKGROUND OF THE INVENTION

1. Field of the Invention

The present invention relates to a cooking apparatus, and more particularly, to an apparatus and a method for monitoring a hot surface of a cooking apparatus, capable of informing a hot surface of a cook top to a user.

2. Description of the Related Art

Recently, electric ovens, electronic ranges, electric ranges, gas ranges, gas oven ranges, and cook tops are used as an apparatus for cooking food at home.

Cook tops of these apparatuses have many problems associated with a user's safety because food is heated with the food put on a hot plate and the user cannot observe a separate flame with his natural eyes. For example, the user thinks that the hot plate is not heated at high temperature, touches the hot plate with his hand, and his hand get burned.

To solve this problem, generally, a separate light-emitting member such as a lamp is added, and the light-emitting member is emitted at a predetermined position of the hot plate when the hot plate reaches high temperature.

However, according to a related art, heater temperature is detected and a hot surface of the hot plate is informed of to a user. At this point, only an alarm according to the heater temperature is provided regardless of an error occurring during an actual cooking operation. In other words, an error associated with a result of detecting the hot surface of the cook top cannot be monitored or judged. Instead, when the hot surface of the cook top is detected, only an alarm regarding the hot surface is provided, and an error or reason of disorder in a system cannot be provided.

For example, even when the hot plate reaches high temperature due to malfunction of a sensor or disorder of the system, an alarm is not provided and a user may be damaged. Also, even though the hot plate does not reach high temperature, an alarm is provided and the user feels uneasy.

SUMMARY OF THE INVENTION

Accordingly, the present invention is directed to an apparatus and a method for monitoring a hot surface of a cooking apparatus that substantially obviate one or more problems due to limitations and disadvantages of the related art.

An object of the present invention is to provide an apparatus and a method for monitoring a hot surface of a cooking apparatus, capable of discriminating an error from the hot surface of the cooking apparatus and displaying the same as well as monitoring detection and display of the hot surface of the cooking apparatus.

Another object of the present invention is to provide an apparatus and a method for monitoring a hot surface of a cooking apparatus, allowing a user to easily understand a relevant disorder when a cooking apparatus abnormally operates.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an apparatus for monitoring a hot surface of a cooking apparatus, the apparatus including: a display unit for displaying a state of a hot surface and an operation error of a hot plate as a heater operates; a temperature detecting sensor installed closely to the heater to detect heater temperature greater than set temperature; and a microprocessor for comparing the heater temperature greater than the set temperature that is detected by the temperature detecting sensor with heater temperature greater than the set temperature that is expected by an elapse of an operating time of the heater to judge one of a hot surface and an operation error of the hot plate, and controlling the judgment results to be displayed using the display unit.

In another aspect of the present invention, there is provided an apparatus for monitoring a hot surface of a cooking apparatus, the apparatus including: a heater; a hot plate heated by the heater; a temperature detecting sensor for detecting whether a hot surface of the hot plate reaches temperature greater than or less than the set temperature; a microprocessor for comparing a state of the hot plate that is detected by the temperature detecting sensor with another state of the hot plate that is expected by an elapse of an operating time of the heater to judge one of a hot surface and an operation error of the hot plate depending on whether the states of the hot plate under comparison are identical to each other; and a display unit for displaying judgment results of the microprocessor.

In further another aspect of the present invention, there is provided a method for monitoring a hot surface of a cooking apparatus, the method including: counting an elapse time for which a heater is in one of on/off states; and when temperature detected by a temperature detecting sensor for detecting temperature of the heater does not change in response to temperature change corresponding to one of the on/off states of the heater even after the elapse time for which the heater is in one of the on/off states elapses a predetermined set time, displaying an error.

According to the present invention, a hot surface of a cooking apparatus can be accurately detected and warned. When disorder of a system occurs, an appropriate signal can be provided to a user conveniently.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
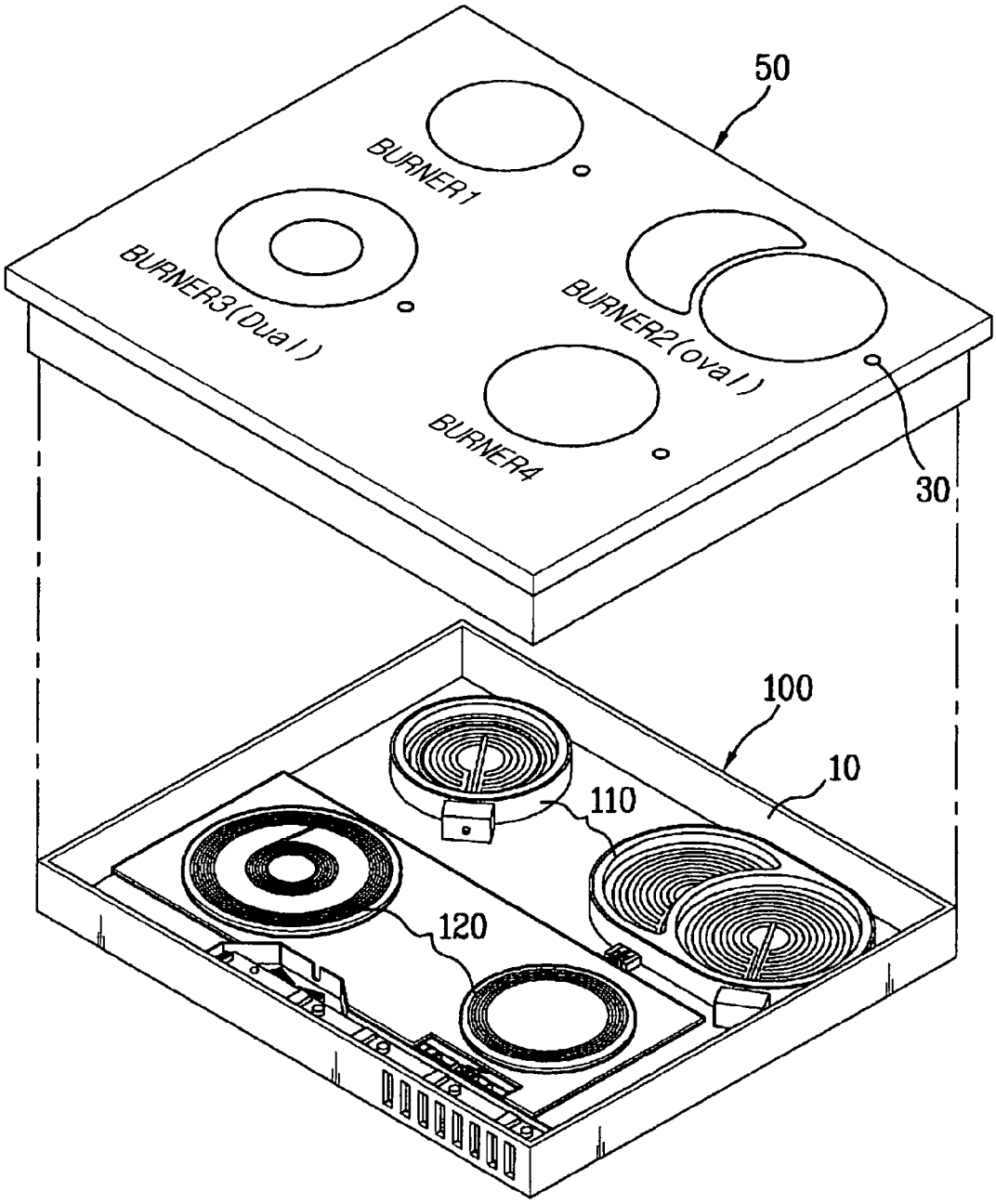
FIG. 1 is a perspective view of a cook top according to the present invention.

FIG. 1 is a perspective view of a cook top according to the present invention.

Referring to FIG. 1, a general cook top includes a main machine 10, a plurality of burner assembly 100, and a plate part 50.

The burner assembly 100 includes electric heaters 110 and 120 emitting heat when power is applied. The electric heaters 110 and 120 can be classified into induction heaters using an induced heating method, and radiant heaters using electric resistance depending on heating methods.

Also, the plate part 50 constitutes an upper surface of a burner so that a variety of cooking containers are put on the upper surface to correspond to a position where the burner assembly 100 is mounted. Positions or kinds of burners are printed on a surface of the plate part 50 so that a user recognizes seating positions of respective burners and puts the cooking containers on exact positions.

Also, a temperature detecting sensor (not shown) is mounted closely to the electric heaters 110 and 120, and a hot state of the plate part 50 is displayed according to heating temperature of the heater detected by the temperature detecting sensor.

To display the hot state of the plate part 50, a display unit 30 is provided to one-to-one correspond to each burner, and provides the hot state of the plate part 50 on the plate part 50 so that the hot state can be checked from the outside. For example, when heating temperature of the heater rises above 65° C. while food is cooked, the display unit 30 corresponding to a relevant burner is allowed to emit light and display that the plate part 50 is in a hot state. Also, the display unit 30 displays the hot state until the heater having extra heat is cooled down below 65° C. even after cooking the food is completed.

Figure 2:
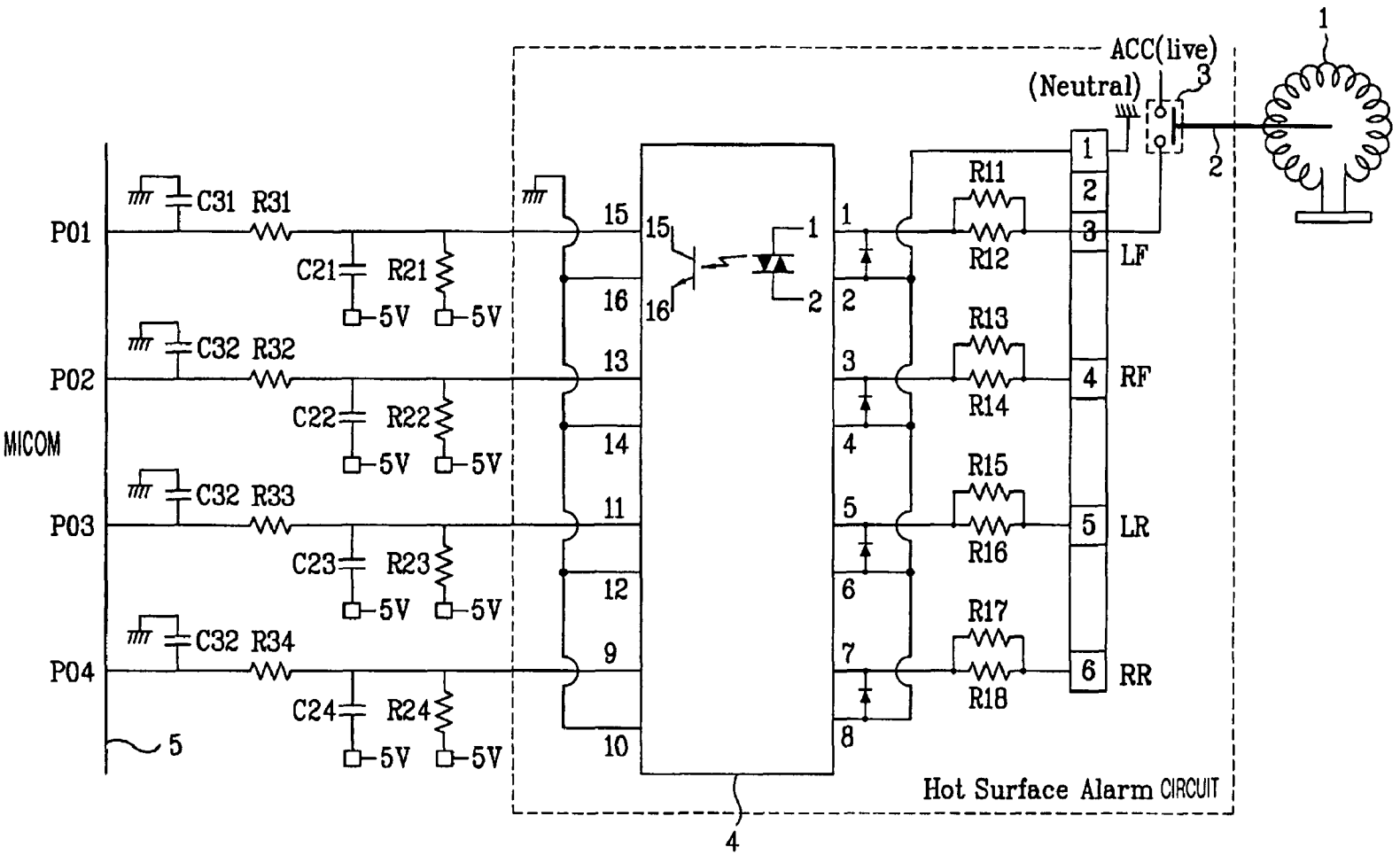
FIG. 2 is a view illustrating a circuit for detecting a hot surface of a cooking apparatus according to the present invention.

FIG. 2 is a view illustrating a circuit of a monitor apparatus for detecting a hot surface of a cooking apparatus according to the present invention.

Referring to FIG. 2, the display unit 30 (of FIG. 1) is provided to one-to-one correspond to each burner so that a user can recognize a hot state of an upper surface of the burner when the heater 1 is in a heating state of more than a set temperature t0 or residual heat remains. A detailed type of the display unit is not limited to the type illustrated in FIG. 1 but any type display unit can be used as far as it displays a hot state to a user.

The display unit 30 operates under control of a microprocessor 5, and can use a seven segment light-emitting diode (LED) or a liquid crystal display (LCD) device in order to display an operation error as well as a hot surface of a burner.

Also, a bi-metal sensor, which is a temperature detecting sensor 2, is closely mounted to a heater 1, which is a heat source of each burner to detect heating temperature of the heater 1 greater than a set temperature t0. At this point, the bi-metal sensor is considerably bent depending on temperature change, and can be designed such that the bi-metal sensor is deformed at a desired temperature level.

A contact point of a switching part 3 is maintained at an off state within a previously set temperature t0 using a property that the bi-metal sensor is deformed. The bi-metal sensor is deformed and the contact point of the switching part 3 is turned on when the heater 1 rises above the set temperature t0. That is, when the heater 1 reaches heating temperature of more than the set temperature t0, the contact point of the switching part 3 is turned on by the bi-metal sensor, and AC power is supplied.

A signal output unit 4 receives AC power through a switching operation of the switching part 3, converts the received AC power into a DC level that can be recognized by the microprocessor 5, and outputs the converted DC level to the microprocessor 5. The signal output unit 4 includes a two-way photodiode conducting by receiving AC level power, and a photodiode driven by light-emission of the photodiode to output a DC level signal.

With this construction, when the heater 1 is heated above the set temperature t0, a live line of AC power and the contact point of the switching part 3 are conducting, so that AC power is output as a DC level signal by way of the signal output unit 4.

A DC output of the signal output unit 4 is delivered to the microprocessor 5 to monitor a hot state of a burner upper surface during an operation of a burner, and further, can be used in detecting an operation error associated with detection of a hot state of the burner.

A method for monitoring a hot surface of a cooking apparatus will be described according to the present invention with reference to FIGS. 3 and 4.

Figure 3:
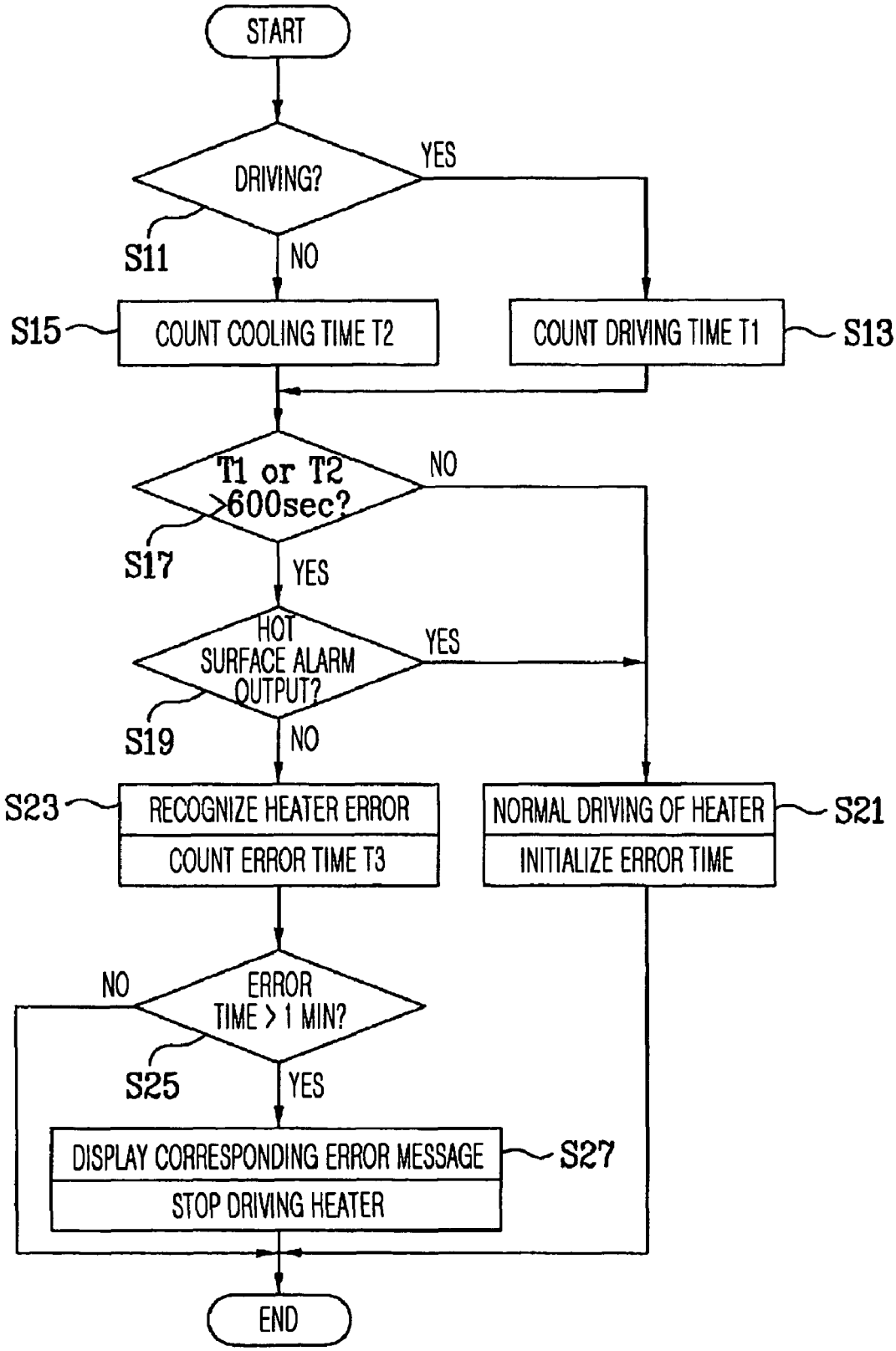
FIGS. 3 and 4 are flowcharts of a method for monitoring a hot surface of a cooking apparatus according to the present invention.

First, referring to FIG. 3, the microprocessor 5 recognizes a DC signal (referred to as a hot state alarming signal) output from the signal output unit 4 depending on heating temperature of the heater 1, and displays whether the burner upper surface is in a hot state through the display unit. That is, a point at which a hot state of the burner upper surface should be displayed is a point when heating temperature of the heater 1 reaches the set temperature t0. A point at which displaying the hot state is stopped is a point when the heater 1 is cooled down below the set temperature t0.

Meanwhile, the microprocessor 5 counts an operating time T1 when the heater 1 receives power and starts to operate, and counts a cooling time T2 when the heater 1 stops an operation.

Table 1 shows a time ($t_{max\ reaching\ time}$) (sec) taken until the heater 1 reaches maximum temperature $t_{max}$, and a time ($t_{0\ cooling\ time}$) (sec) taken until the heater is cooled down from the maximum temperature $t_{max}$ to below a set temperature $t_0$ at which displaying the hot state is stopped.

TABLE 1

| P/L | $T_{0\ reaching\ time}$ | $T_{max\ reaching\ time}$ | Entire time | $T_{0\ cooling\ time}$ | Coefficient |
|---|---|---|---|---|---|
| 9 | 240 | 660 | 900 | 2400 | 0.28 |
| 8 | 330 | 640 | 970 | 2060 | 0.31 |
| 7 | 420 | 620 | 1040 | 1720 | 0.36 |
| 6 | 510 | 600 | 1110 | 1380 | 0.43 |
| 5 | 600 | 580 | 1180 | 1040 | 0.56 |

Here, a driving time T1 is counted by adding a time by one second unit while the heater 1 is driven. Time data shown in Table 1 have been derived.

Meanwhile, a cooling time T2 is counted by subtracting a time from the driving time T1 after the driving heater 1 is stopped, that is, when cooling is performed. In detail, a coefficient that should be subtracted during a cooling operation is calculated so that the cooling time T2 becomes zero at a point when the heater 1 reaches the set temperature t0. This coefficient is determined as a constant counting the cooling time T2 while the heater 1 is cooled down to calculate a virtual cooling time T2, which is compared.

Consequently, a current cooling time T2 after a predetermined time elapses since stoppage of the heater 1 is determined as a value obtained by subtracting an actual time that has elapsed after the stoppage of the heater 1 from the $t_{0\ cooling\ time}$, and multiplying the subtracted value by the coefficient.

The coefficient is determined in the above-described process because the $T_{max\ reaching\ time}$ and $t_{0\ cooling\ time}$ change by a predetermined rate as a power level changes. In other words, the coefficient is determined in the above-described process so that the driving time T1 and the cooling time T2 can be compared to a predetermined comparison value, e.g., 600 sec regardless of a power level.

Referring to Table 2, a power level (P/L) of a heater operates with a basic cycle and an on-time. When an on-time is short within a cycle, there is high possibility that the heater does not reach hot surface alarming temperature (i.e., the set temperature $t_0$).

TABLE 2

| P/L | On time (sec) | Cycle (sec) |
|---|---|---|
| LOW | 1.0 | 50.0 |
| 1.0 | 2.0 | 50.0 |
| 2.0 | 4.2 | 30.0 |
| 3.0 | 7.2 | 30.0 |
| 4.0 | 9.0 | 30.0 |
| 5.0 | 10.8 | 30.0 |
| 6.0 | 13.2 | 30.0 |
| 7.0 | 15.6 | 30.0 |
| 8.0 | 19.8 | 30.0 |
| 9.0 | 26.4 | 30.0 |
| HIGH | 30.0 | 30.0 |

Figure 4:
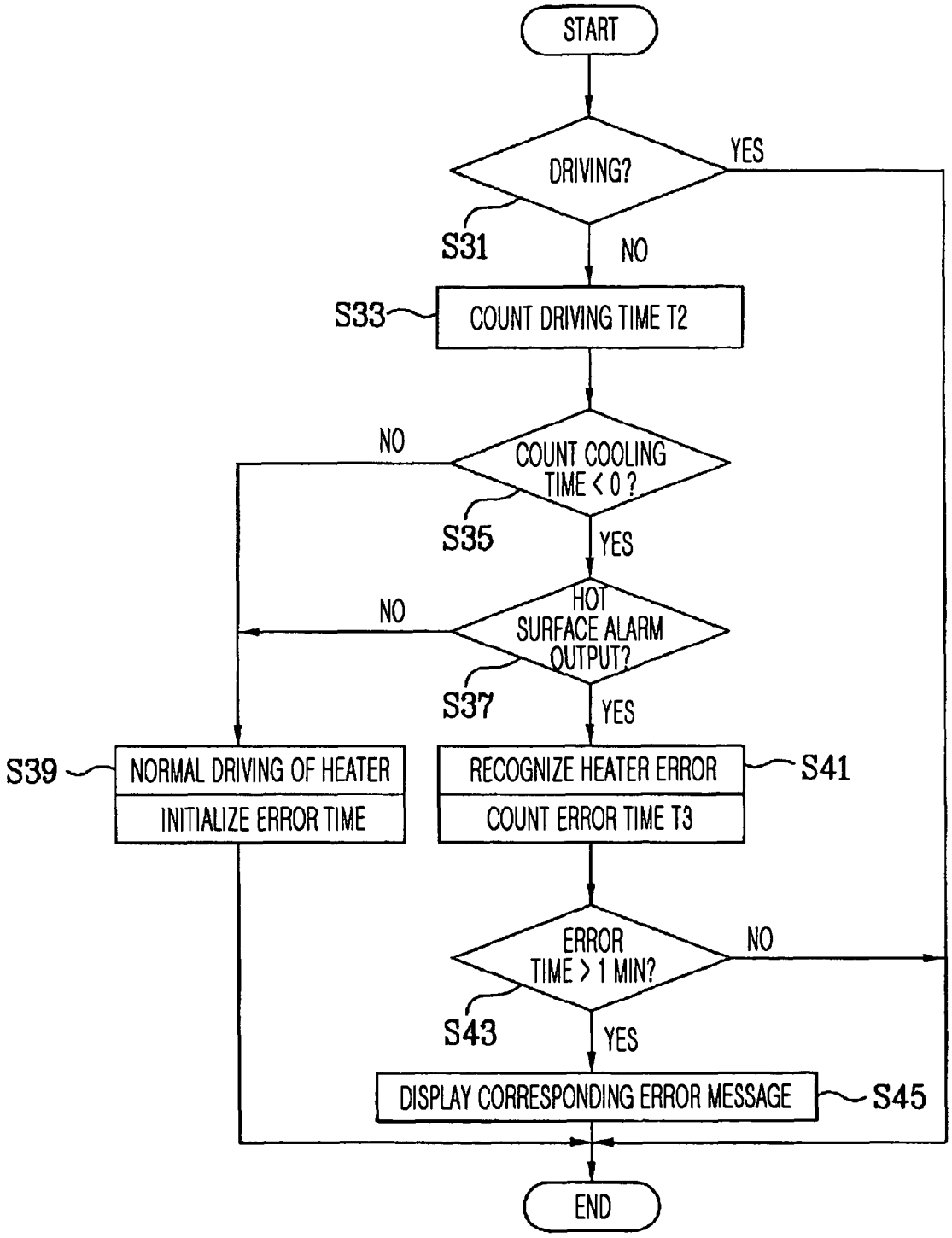

Therefore, basic on-time conditions under which the heater can reach the hot surface alarming temperature t0 obtained by experiments show that it is preferable that an algorithm shown in FIG. 3 is applied at a power level that allows the heater to reach the hot surface alarming temperature t0, and an algorithm shown in FIG. 4 is applied at a power level that does not allow the heater to reach the hot surface alarming temperature t0. For example, the algorithm shown in FIG. 3 is applied at a power level greater than 5, and the algorithm shown in FIG. 4 is applied at a power level less than 4.

Also, a logic can be formed such that a monitoring operation is not performed for less than ten minutes during a lowest fifth step while the heater 1 initially operates even at a power level of 5 or more, and temperature is monitored after the heater 1 is turned on and an aging operation is performed for more than five seconds.

First, a method for monitoring a hot surface that is applied to a power level of 5 or more will be described in detail with reference to FIG. 3.

While the heater 1 is driven, the driving time T1 is counted by adding a time by one second unit. While the heater 1 is cooled down, the cooling time T2 is counted by multiplying a time by the coefficient corresponding to a current power level (S11, S13, and S15). A method for calculating the cooling time T2 has already been described in detail.

Subsequently, whether the counted driving time T1 or cooling time T2 is greater than the set time T0 is judged (S17).

At this point, the set time T0 may be set to a $t_{0\ reaching\ time}$ of a minimum level, for example, 600 sec of Table 1 with reference to the minimum level having a largest $t_{0\ reaching\ time}$ of power levels to which the algorithm of FIG. 3 is applicable.

Simultaneously with judging whether the driving time T1 or the cooling time T2 is greater than the set time T0, whether the signal output unit 4 outputs a current hot surface alarming signal is judged (S19).

When the driving time T1 or the cooling time T2 is greater than the set time T0 and the current hot surface alarming signal is output as a result of the judgments in S17 and S19, both driving of the heater 1 and the detection of the hot surface are recognized as normal, and an error time T3 counted when an error occurs is initialized (S21).

Meanwhile, when the current hot surface alarming signal is not output even though the driving time T1 or the cooling time T2 is greater than the set time T0 as a result of the judgments in S17 and S19, it is judged that an error has occurred while the heater 1 is driven or during a temperature detecting process, and counting the error time T3 starts (S23).

At this point, when an error state is maintained and the error time T3 elapses for more than one minute, a corresponding error message is displayed and driving the heater is stopped in the case where the heater is driven (S25 and S27).

Therefore, when a hot surface alarming signal is not detected even though the driving time T1 or the cooling time T2 is greater than the set time T0 with reference to a t0 reaching time (i.e., the set time T0) of the minimum level, e.g., 600 sec in the above, it is judged that there occurs an operation error in detecting the hot surface of the hot plate.

A method for monitoring a hot surface applied to a power level of 4 or less will be described in detail with reference to FIG. 4.

In the case of a power level of 4 or less, an algorithm for a cooling state after driving stoppage may be applied instead of an algorithm applied while the heater 1 is driven. The method for monitoring the hot surface is applied even to a power level in which the heater 1 does not reach $t_{0\ reaching\ time}$ because an error may be generated due to disorder of parts such as a sensor. In this case, verification is performed on only the cooling time to check whether an error occurs in order to prevent resources of the system from being wasted.

In detail, when the operating heater 1 stops and is cooled down, the cooling time T2 is counted using the above-described method (S31 and S33).

At this point, since the heater 1 does not reach the hot surface alarming temperature t0 at a power level of 4 or less, a to cooling time becomes zero and an actual cooling time T2 always has a value of zero or less.

That is, whether the cooling time T2 is zero and whether a hot surface alarming signal is output are judged (S35 and S37). When the cooling time T2 is zero or less and a current hot surface alarming signal is not output as a result of the judgments in S35 and S37, both driving of the heater 1 and the detection of the hot surface are recognized as normal, and an error time T3 counted when an error occurs is initialized (S39).

Meanwhile, when the current hot surface alarming signal is output even though the cooling time T2 is zero or less as a result of the judgments in S35 and S37, it is judged that an error has occurred while the heater 1 is driven or during a temperature detecting process, and counting the error time T3 starts (S41).

At this point, when an error state is maintained and the error time T3 elapses for more than one minute, a corresponding error message is displayed and driving the heater is stopped in the case where the heater is driven (S43 and S45).

Therefore, when the hot surface alarming signal is detected even though a state of the hot surface does not need to be displayed at a power level of 4 or less where the heater 1 does not reach the hot surface alarming temperature t0, it is judged that there occurs an operation error in detecting the hot surface of the hot plate.

Referring to FIGS. 3 and 4, when it is judged that there occurs the operation error in detecting the hot surface of the hot plate, an error message is displayed. At this point, an error code (e.g., "F5") meaning a corresponding error data is displayed on the display unit, so that a user can understand disorder type of a product more easily.

According to the present invention, it is possible to judge an operation error in detecting a hot surface as well as the hot surface of the hot plate by monitoring whether heating temperature of the heater greater than the set temperature t0 is detected using a bi-metal sensor besides the driving time T1 or the cooling time T2 of the heater 1.

Meanwhile, though the cook top is exemplarily described in the above embodiments, the present invention is not limited to the cook top but can be readily modified and applied to various cooking apparatus.

An apparatus and a method for monitoring a hot surface of a cooking apparatus according to the present invention can alarm a hot surface of a burner upper surface depending on heating temperature of a heater, and monitor a hot surface detecting error using a driving time or a cooling time of the heater.

Also, an exact disorder type is informed of to a user in the case where a hot surface of a burner upper surface is not properly displayed, so that the user can take a swift and necessary measure. Therefore, danger in using a product caused by product disorder can be prevented.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An apparatus for monitoring a hot surface of a cooking apparatus, the apparatus comprising:

a heater configured to emit heat, the heater to define a maximum temperature that can be obtained based on a power level thereof;

a display unit that includes an LED or an LCD device for displaying a state of a hot surface of a hot plate and an operation error of the hot plate;

a temperature detecting sensor provided close to the heater to detect a heater temperature greater than a set temperature; and a microprocessor for controlling displaying of the display unit and to provide a hot surface alarm that the hot surface of the hot plate is in a hot state when the temperature detecting sensor detects that the heater temperature is greater than the set temperature, wherein the microprocessor determines the operation error of the hot plate when a calculated cooling time is greater than a set time and the hot surface alarm is not provided, the cooling time being a calculated time period in a state where the heater is not powered, and the set time being greater than zero, wherein the cooling time is a value calculated by:

determining an actual time that is a time period from when the heater stops to the time the calculation is to be performed, obtaining a subtracted value by subtracting the determined actual time from a predetermined cooling time, the predetermined cooling time being a time period stored in memory that corresponds to a time from when the heater is turned off at the maximum temperature until the heater temperature reaches the set temperature, and obtaining the calculated cooling time by multiplying the subtracted value by a predetermined set coefficient, wherein the predetermined set coefficient is less than 0.56 and is determined by dividing a maximum heating time by the predetermined cooling time, wherein the maximum heating time is a time period when the heater reaches from the set temperature to the maximum temperature.

2. The apparatus according to claim 1, further comprising:

a switching unit for switching AC power when the temperature detecting sensor detects that the heater temperature is greater than the set temperature; and a signal output unit for receiving the AC power through the switching unit, converting the AC power into a DC level signal, and outputting the converted DC level signal to the microprocessor.

3. The apparatus according to claim 1, wherein the temperature detecting sensor comprises a bi-metal sensor deformed at the heater temperature greater than the set temperature.

4. The apparatus according to claim 1, wherein the heater comprises an electric-driven type heater.

5. The apparatus according to claim 1, wherein food to be cooked is put on the hot plate.

6. A method for monitoring a hot surface of a cooking apparatus, the method comprising:

determining a cooling time of the cooking apparatus, the cooling time being a calculated time period in a state where a heater is not powered on;

determining whether the cooling time is greater than a set time, and the set time being greater than zero;

outputting a hot surface alarm signal of a state of the hot surface of the cooking apparatus when the determined cooling time is determined to be greater than the set time; and displaying an error when the determined cooling time is zero or less and the hot surface alarm signal is output in a state where a power level of the heater is lower than a set level, wherein the cooling time is a value determined by:

determining an actual time that is a time period from when the heater stops to the time the calculation is to be performed, obtaining a subtracted value by subtracting the determined actual time from a predetermined cooling time, the predetermined cooling time being a time period stored in memory that corresponds to a time from when the heater is turned off at the maximum temperature until the heater temperature reaches the set temperature, and obtaining the calculated cooling time by multiplying the subtracted value by a predetermined set coefficient, wherein the predetermined set coefficient is less than 0.56 and is determined by dividing a maximum heating time by the predetermined cooling time, wherein the maximum heating time is a time period when the heater reaches from the set temperature to the maximum temperature.

7. The method according to claim 6, wherein the displaying of the error comprises displaying the error when the error is maintained for a predetermined time.

8. The apparatus according to claim 1, wherein the microprocessor determines whether the calculated cooling time is zero or less and the hot surface alarm is not output when a power level of the heater is lower than a set level.

9. The apparatus according to claim 1, wherein the set coefficient may be determined so that the calculated cooling time becomes zero at a point when the heater temperature reaches the set temperature.

* * * * *